US005141003A

United States Patent [19]

Dawson et al.

[11] Patent Number: 5,141,003

[45] Date of Patent: Aug. 25, 1992

[54] CIGARETTE MAKING MACHINE

[75] Inventors: John Dawson; Andrew Martin, both of 2 Sir William Lyons Road, University of Warwick Science Park, Coventry, CV4 7EZ, England

[73] Assignees: John Dawson; Andrew Martin

[21] Appl. No.: 694,366

[22] Filed: May 1, 1991

[30] Foreign Application Priority Data

May 2, 1990 [GB] United Kingdom ..... 9009856

[51] Int. Cl.[5] ..... A24C 5/14

[52] U.S. Cl. ..... 131/108; 131/109.1

[58] Field of Search ..... 131/84.1-84.4, 131/108, 109.1; 198/454, 455, 450

[56] References Cited

U.S. PATENT DOCUMENTS

| | | | |
|---|---|---|---|
| 826,800 | 7/1906 | Prescott | 131/109.1 X |
| 3,030,965 | 4/1962 | Labbe | 131/84.3 X |
| 3,039,473 | 6/1962 | Schubert | 131/84.4 |
| 3,173,424 | 3/1965 | Gamberini | 131/84.3 |

FOREIGN PATENT DOCUMENTS

| | | | |
|---|---|---|---|
| 1125826 | 3/1962 | Fed. Rep. of Germany | 131/84.3 |
| 0826914 | 4/1938 | France | 131/109.1 |
| 488617 | 7/1938 | United Kingdom | 131/109.1 |

*Primary Examiner*—V. Millin
*Assistant Examiner*—J. Doyle
*Attorney, Agent, or Firm*—Antonelli, Terry Stout & Kraus

[57] ABSTRACT

Cigarette making machine including two suction bands arranged to move towards one another and having tobacco showered onto the bands. The two bands form two tobacco sub-streams from showered tobacco and upon merger form one stream. At the point of merger additional tobacco is added to the stream so as to form dense end portions.

7 Claims, 4 Drawing Sheets

CIGARETTE MAKING MACHINE

This patent application is concerned with improvements or modifications with respect to the invention described in commonly assigned U.S. patent application Ser. No. 729,889, filed Jul. 11, 1991, which is a continuation of U.S. patent application Ser. No. 377,521, filed Jul. 10, 1989, now abandoned. The features described in the present application may be used independently of one another or in any desired combination.

According to one aspect of the present invention, the removal of excess tobacco in a cigarette making machine of the type described in our above-mentioned U.S. application is achieved by blowing or sucking a variable quantity of tobacco through one or more openings in a wall of the shower channel through which tobacco is showered towards the two suction bands. Examples are described below with reference to FIGS. 3 and 4.

According to another aspect of this invention, cigarette dense ends are formed by feeding quantities of tobacco at regular intervals into the "merger point" (as defined in the above-mentioned U.S. application) by means of a wheel having recesses which accumulate measured quantities of tobacco from tobacco showered towards the two suction bands or from an external source of tobacco. Examples of this aspect of the invention are described below with reference to FIGS. 6 to 8.

According to another aspect of this invention, the two suction bands described in the above-mentioned U.S. application may be omitted. In their place there may be converging fixed surfaces having apertures through which air is blown so as to convey the tobacco along the surfaces in the manner of air movers. An example is described below with references to FIG. 10.

According to another aspect of this invention, the tobacco showered through the shower channel may be received by two suction bands which move along diverging paths, and these bands may transfer the substreams formed on them to further suction bands converging towards the merger point, or alternatively the initial bands may include further runs which converge towards the merger point. Examples are described below with reference to FIGS. 11 and 12.

Other aspects of this invention, although not generally defined in this specification, will be clear from the following description.

Examples of cigarette making machines according to this invention are shown diagrammatically in the accompanying drawings. In these drawings.

Figure 1:
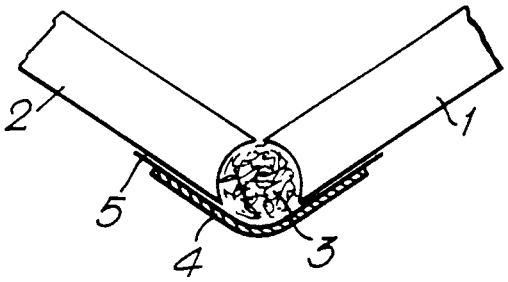
FIG. 1 is a cross-sectional view illustrating an extension of the modification shown in FIG. 6 of our above-mentioned U.S. application.
Figure 6:
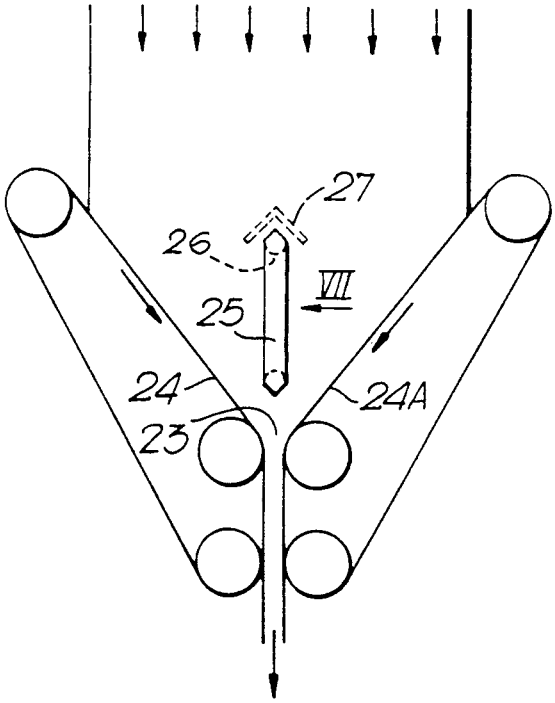
FIG. 6 is a plan view of another machine with provision for dense ending.

FIG. 1 shows an extension of the proposal contained in FIG. 6 of above-mentioned U.S. application whereby the downstream pulleys 1 and 2 (corresponding to pulleys 68 and 69 in FIG. 6 of the above U.S. application) are further tilted in an upward direction. The effect of this is that approximately a 120 degree arc of the upper circumference of the cigarette stream 3 is defined by the pulleys, or more specifically by the suction bands passing around the pulleys. This reduces the need for a deeply concave shape to the pulleys in order to form the filler stream into a circular cross-section. In fact, the suction bands in this case may be flat in cross-section.

In order to position the pulleys 1 and 2 as shown in FIG. 1, instead of simply twisting the pulleys out of the plane of the other pulleys. Each suction band with its associated pulleys may be inclined to the horizontal at the angle shown in FIG. 1. This requires a shower channel which is V-shaped in cross-section.

Figure 2:
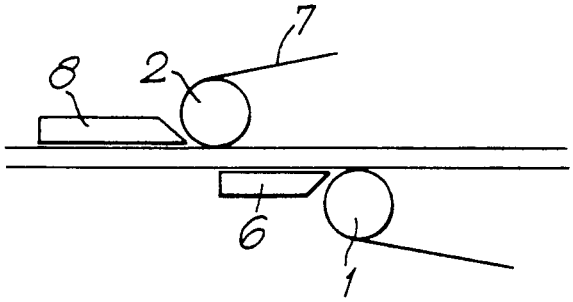
FIG. 2 is a plan view of part of the machine shown in FIG. 1.

Below the pulleys 1 and 2, as in a conventional machine, runs a garniture tape 4 carrying a continuous cigarette wrapper web 5. The wrapping of the web 5 around the cigarette filler stream may be achieved in the manner shown in plan view by FIG. 2. That is to say, the pulleys 1 and 2 may be staggered to allow a first folder 6 to fold over one side of the wrapper web before the tobacco is entirely cleared by the second suction tape 7 passing around the pulley 2. Downstream of the pulley 2 there is a second folder 8.

Figure 3:
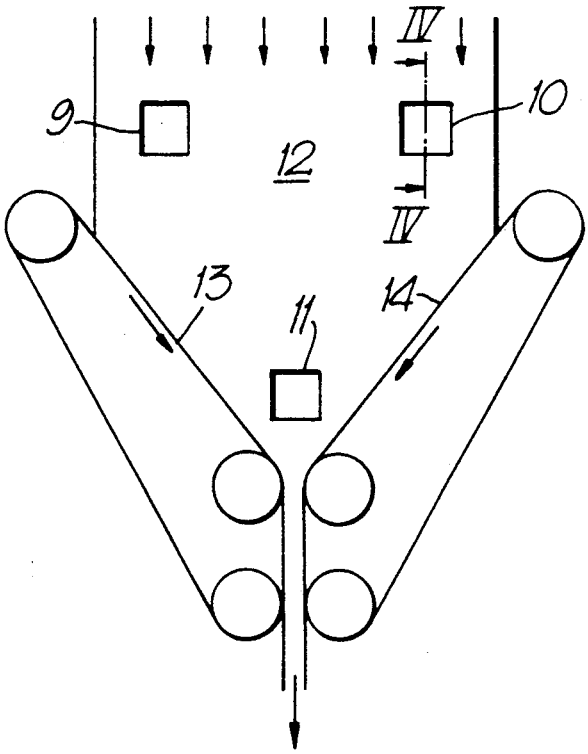
FIG. 3 is a plan view of part of a different machine.
Figure 4:
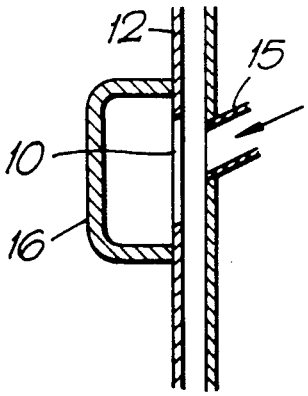
FIG. 4 is a section along the line IV—IV in FIG. 3.

FIGS. 3 and 4 show an arrangement for pneumatically trimming the showered tobacco. In response to a tobacco (or cigarette) weight or density sensor (not shown), excess tobacco is blown laterally (i.e. upwards or downwards) through one or more openings 9, 10 and 11 formed in a wall 12 of the shower channel through which tobacco is showered towards suction bands 13 and 14. FIG. 4 shows the opening 10 in the wall 12. Opposite to the opening 10 is an air inlet 15 through which air is blown across the shower channel to project a variable quantity of tobacco into a collection chamber 16 when (and to the extent) necessary to maintain the cigarette weight substantially constant. The collection channel 16 is maintained at an internal pressure normally equalling that in the shower channel, so that no tobacco passes through the opening 10 except when air is blown through the inlet 15. Air is blown or sucked continuously through the channel 16 to remove the tobacco which is blown into the channel through the opening 10.

Instead of the arrangement shown in FIG. 4, tobacco may be sucked out through the opening 10. This may be achieved by means of an air mover passing air across the opening 10 and through the collection channel 16. In this case, the inlet 15 would be maintained at a constant pressure equalling the normal pressure in the shower channel.

In general terms, all three openings 9, 10 and 11 may be provided. However, in a preferred arrangement either the openings 9 and 10 or the opening 11 alone would be provided. The tobacco stream, for the purpose of weight control, may be monitored by means of an infra-red device looking vertically through the collected tobacco at the merger point immediately downstream of the opening 11. Alternatively, a light beam (e.g. infra-red) may be directed horizontally through the shower channel immediately upstream of the openings and 10. Another alternative is to use a beam of electro-magnetic radiation in the micro-wave region of the spectrum; if the reflected beam is detected (as opposed to the beam transmitted through the tobacco), the magnitude would indicate tobacco density and the frequency would indicate tobacco velocity. A further or additional means of controlling the ejection of excess tobacco may consist of the usual cigarette nucleonic weight control; this may be used as the sole means of weight detection, or in combination with one or more infra-red or other light beams as described above.

Figure 5:
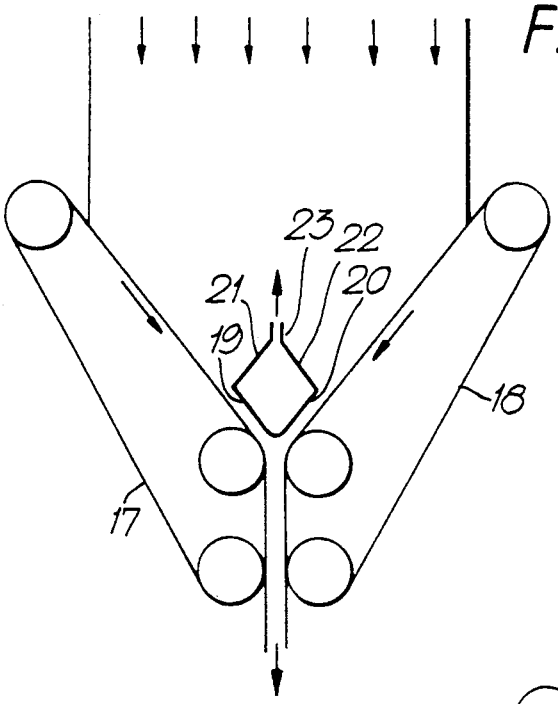
FIG. 5 is a plan view of another different machine.

FIG. 5 illustrates an arrangement for preventing excessively large lumps of tobacco from entering the space between the suction bands 17 and 18. This consists of roof members 19 and 20 parallel to the adjacent parts of the respective bands. Tobacco is deflected away from these members (and onto the respective bands 17 and 18) by walls 21 and 22. The resulting enclosure formed by the members 19 to 22 is supplied internally with pressure air so that air blows out through an aperture at the apex 23 to prevent tobacco catching at that point. There may also be outlets at the junction of the members 20 and 22 and of the members 19 and 21 arranged to direct air parallel to the bands 18 and 17 in directions opposite to the motions of the respective bands.

Figure 7:
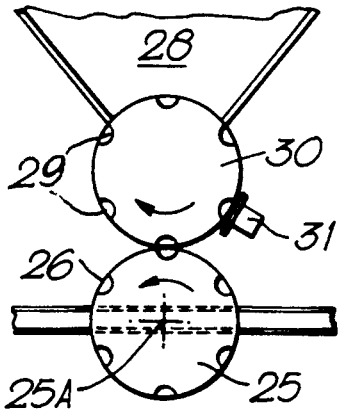
FIG. 7 is a view, in the direction of the arrow VII in FIG. 6, of a modified form of the machine shown in FIG. 6.

FIG. 6 shows an arrangement for feeding measured quantities of tobacco at regular intervals into the merger point 23 between the suction bands 24 and 24A. This consists of a wheel 25 formed with recesses 26 at regular intervals around its periphery; the axis of rotation 25A of the wheel is in the plane containing the bands, as illustrated in FIG. 7. movement of the wheel periphery in the region of the merger point being transverse to both bands. Tobacco enters the recesses directly from the stream of tobacco showered through the shower channel. Each recess has means for holding the tobacco in it by means of suction (illustrated in FIG. 8) until the tobacco reaches the merger point, whereupon it is released from and possibly blown out of the recess as described below with reference to FIG. 8.

FIG. 7 shows a modification whereby tobacco is fed into the recesses in the wheel 25 from an external source, in which case tobacco flowing towards the wheel in the shower channel is deflected away by a fixed diverter 27 shown in dotted outline in FIG. 6. The external source in this example consists of a hopper 28 from which measured quantities of tobacco are extracted in recesses 29 in a wheel 30 which transfers the quantities of tobacco to the recesses 26 in the wheel 25. A trimming device 31 may be provided to remove excess tobacco from the recesses 29.

Figure 8:
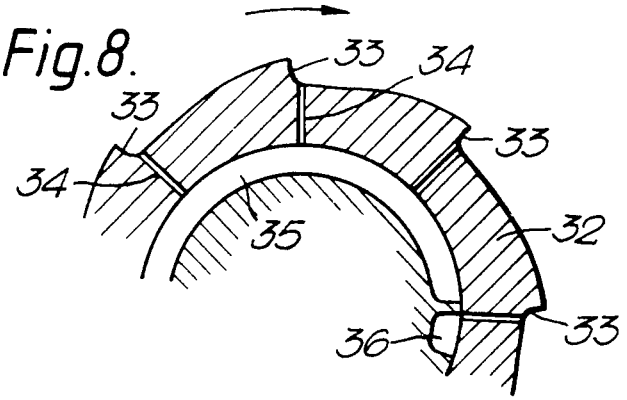
FIG. 8 shows a peripherally recessed wheel suitable for use in the machines shown in FIGS. 6 and 7.

FIG. 8 illustrates an alternative shape for a wheel 32 which corresponds to the wheel 25 and is intended to receive tobacco directly from the showered channel. It will be seen that the shape of the periphery of the wheel 32 is such that recesses 33 are provided at regular intervals, one side of each recess being in the form of a surface of gradually increasing radius so that tobacco arriving on this surface can readily slide into the corresponding recess. Each recess has an associated radial passageway 34 to which suction is initially transmitted from an annular chamber 35 which terminates just prior to the position at which the collected quantity of tobacco in each recess is required to be ejected into the merger point. Ejection is aided in this instance by pressure air supplied via a chamber 36.

Figure 9:
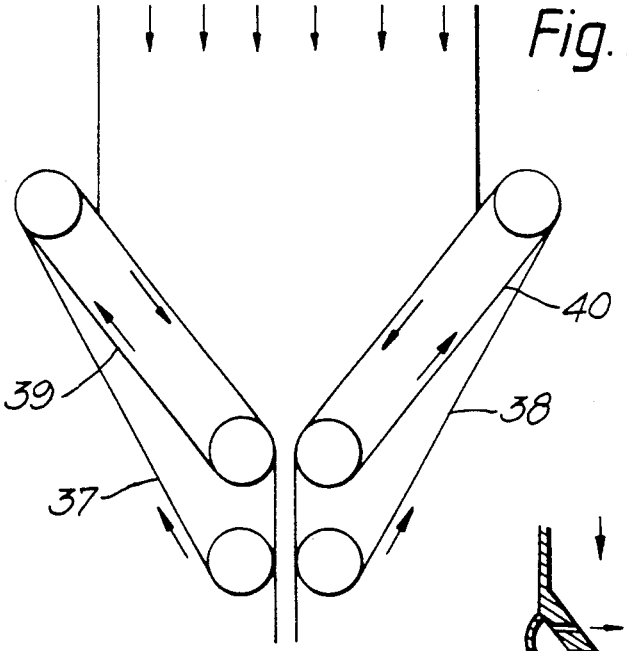
FIG. 9 shows a different provision for dense ending.

FIG. 9 shows an alternative way of forming dense ends directly on the converging runs of suction bands 37 and 38 which are uniformly airpermeable along their lengths. In the region where tobacco is showered onto these bands, the bands are supported by wider bands 39 and 40. The bands 39 and 40 are perforated so that suction can be transmitted through them to the bands 37 and 38. However, the bands 39 and 40 have larger perforations at areas regular spaced along the bands to promote the collection of tobacco at those areas, which correspond to the cigarette end portions and thus form denser end portions.

Figure 10:
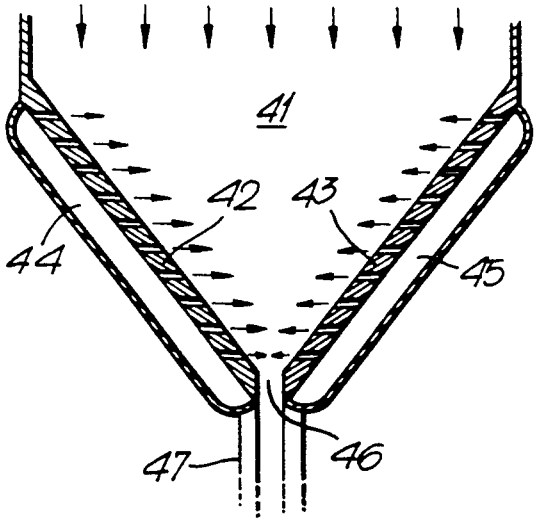
FIG. 10 shows another form of machine omitting the suction bands.

FIG. 10 illustrates an alternative form of machine in which the converging suction tapes have been omitted. Instead, tobacco showered through the shower channel 41 arrives on fixed converging surfaces 42 and 43. The surfaces are formed with forwardly inclined air bores through which air is blown from pressure manifolds 44 and 45 to propel the tobacco along the surfaces 42 and 43 and towards the merger point 46 at which the competed cigarette filler stream is deposited on a continuous wrapper web 47 carried by a garniture tape (not shown).

Figure 11:
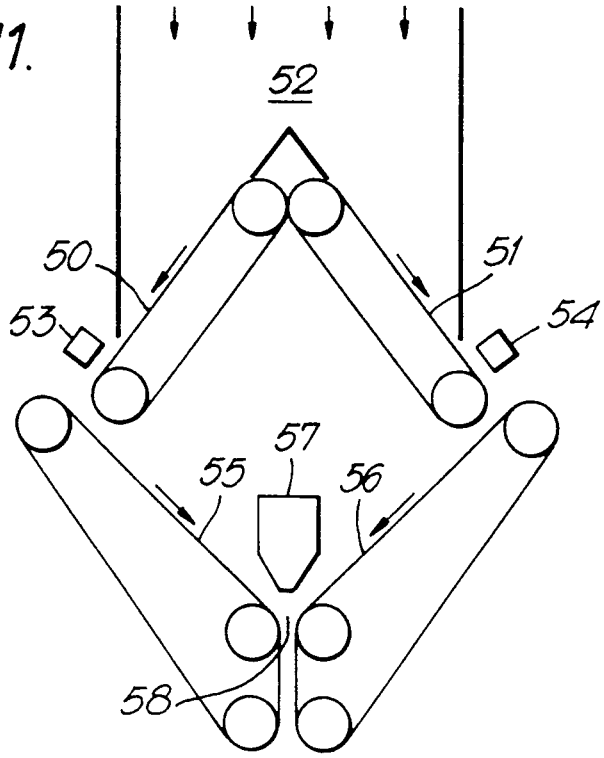
FIG. 11 shows another different form of machine involving the use of diverging suction bands.

FIG. 11 shows an alternative form of machine in which the converging suction tapes of the previous examples are replaced by diverging suction tapes 50 and 51. Tobacco is showered towards the tapes through a shower channel 52. and it will be seen that the direction of movement of the tapes 50 and 51 is such that there is again a forward component. Tobacco substreams formed on the tapes 50 and 51 may each be trimmed by devices 53 and 54 before passing onto further suction tapes 55 and 56 which generally correspond to the converging suction tapes of the previous examples. A device 57 in any suitable form may be provided to deliver additional quantities of tobacco at regular intervals into the merger point 58 to form dense ends; it may also, or alternatively, inject a substantially continuous but controllably variable quantity of tobacco for the purpose of weight control.

Figure 12:
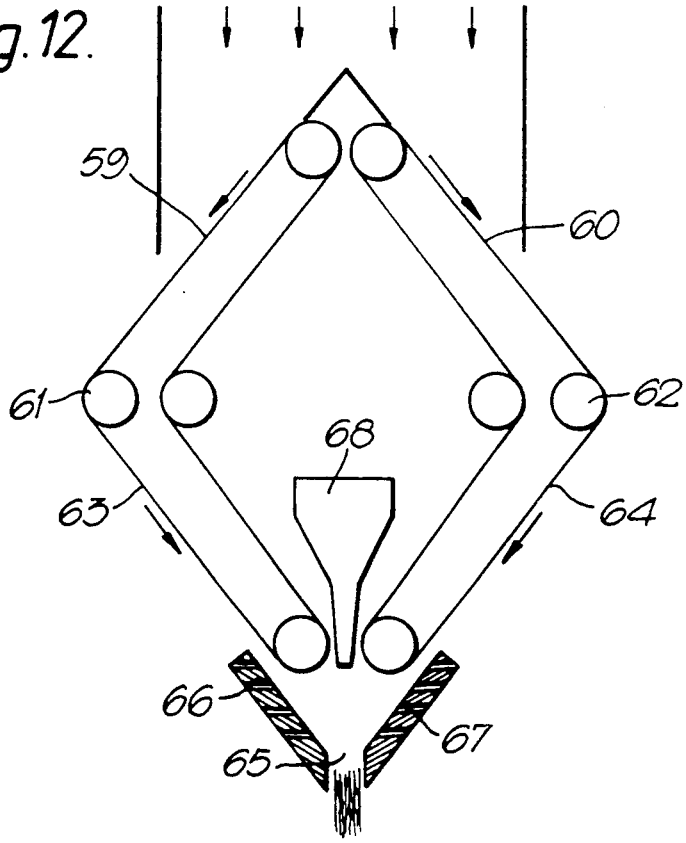
FIG. 12 shows a modification of the machine shown in FIG. 11.

FIG. 12 shows a modification of the arrangement shown in FIG. 11. In this instance there are two suction tapes 59 and 60 which initially receive showered tobacco as in FIG. 11, but in this case the tapes 59 and 60 continue around pulleys 61 and 62 and have converging runs 63 and 64 which convey the tobacco sub-streams towards the merger point 65. The final conveyance of the sub-streams may be by means of air jets passing obliquely from fixed walls 66 and 67 as in FIG. 10. Again a device 68 in any suitable form may be provided for dense ending purposes and/or weight control.

We claim:

1. A cigarette making machine including means for showering tobacco towards two suction bands arranged to move towards one another so as to form two tobacco sub-streams from the showered tobacco and to merge the substreams, at a merger point where the bands are closest, to form one stream, and a wheel formed with recesses at circumferentially spaced positions around its periphery which are arranged to deliver additional measured quantities of tobacco exclusively to the merger point at regular intervals to form dense end portions.

2. A cigarette making machine including means for showering tobacco towards two suction bands arranged to move towards one another so as to form two tobacco sub-stream from the showered tobacco and to merge the sub-streams, at a merger point where the bands are closest, to form one stream and a wheel formed with recesses at circumferentially spaced positions around its periphery which are arranged to deliver measured quantities of tobacco to the merger point at regular intervals to form dense end portions, in which the wheel includes suction passages by which each quantity of tobacco is held in the recess until it reaches and is released into the merger point.

3. A machine according to claim 1 in which the axis about which the wheel rotates is substantially in a plane containing the two suction bands, movement of the wheel periphery in the region of the merger point being transverse to both bands.

4. A machine according to claim 2 in which the recesses of the wheel are arranged to receive tobacco directly from the tobacco showered towards the two suction bands.

5. A machine according to claim 2 in which a feeder wheel with circumferentially spaced recesses is arranged to receive tobacco in its recesses and to deliver the tobacco into the recesses of the first-mentioned wheel.

6. A machine according to claim 5 including a tobacco hopper adjacent to the feeder wheel for delivering tobacco into the recesses in the feeder wheel.

7. A machine according to claim 5, including a trimming device for removing excess tobacco protruding from the recesses of the feeder wheel.

* * * * *